United States Patent [19]

Coast

[11] 4,245,829

[45] Jan. 20, 1981

[54] BAG FOLDING MACHINE

[75] Inventor: John B. Coast, Baton Rouge, La.

[73] Assignee: Union Carbide Corporation, New York, N.Y.

[21] Appl. No.: 28,438

[22] Filed: Apr. 9, 1979

[51] Int. Cl.[3] ..... B65H 45/14

[52] U.S. Cl. ..... 493/439; 493/462; 53/118

[58] Field of Search ..... 270/68 R, 68 A, 69, 270/83, 61; 93/84 R; 53/118

[56] References Cited

U.S. PATENT DOCUMENTS

| | | | |
|---|---|---|---|
| 3,106,877 | 10/1963 | Larson | 270/68 R X |
| 3,671,033 | 6/1972 | Coast | 270/83 |
| 3,918,698 | 11/1975 | Coast | 270/83 X |
| 4,164,177 | 8/1979 | Canfield | 53/118 X |
| 4,180,256 | 12/1979 | Coast | 270/83 |
| 4,183,515 | 1/1980 | Coast | 270/83 |

*Primary Examiner*—E. H. Eickholt

*Attorney, Agent, or Firm*—Steven J. Hultquist

[57] ABSTRACT

An improvement in a bag folding machine of the type which winds the bag into a roll in a rolling cage, the improvement which comprises utilizing the same rolling components used to roll the bag to also flatten fold the rolled bag prior to discharge.

10 Claims, 3 Drawing Figures

BAG FOLDING MACHINE

The present invention relates to a machine for flatten-folding flexible plastic sheet material such as plastic bags and more particularly to an improvement in folding machines of the type which winds the bag into a roll and discharges the rolled bag in a flatten-folded state.

The present invention is specifically directed to folding machines of the type disclosed in U.S. Pat. No. 3,918,698, entitled "High Speed Machine and Method for Folding Plastic Bags and the Like" which issued on Nov. 11, 1975 in the name of John Coast and U.S. Pat. No. 3,671,033, entitled "Machine and Method for Folding Plastic Bags and the Like" which issued on June 20, 1972, also in the name of John Coast.

The above patents, the disclosures of which are herein incorporated by reference, each disclose the use of a rolling section which forms a curved moving surface disposed a minimum of 270° of a circle for winding the material into a roll. The rolling section is divided into at least two laterally separated sub-sections which are spaced apart to form an open unobstructed area therebetween for removing the rolled bag. Each sub-section is formed from a set of horizontally disposed parallel drive rollers whose axes are disposed a minimum of 270° of a circle to present on their inward side and within each sub-section a moving surface throughout at least a substantial portion of the 270° of a circle for driving the material into a roll. The rollers are arranged to form, in effect, a cul-de-sac having an entrance opening adapted for receiving the material. After the bag is rolled, it is removed through the open area between the laterally spaced sub-sections.

According to U.S. Pat. No. 3,671,033, the rolled articles, such as rolled plastic bags, are discharged and flattened by a pin and pneumatic cylinder which engages the longitudinal center of the rolled plastic bag at the space provided between the laterally separated sub-sections of the rolling apparatus. The rolled article is then delivered, centrally folded to a set of nip rolls where it is flattened.

According to U.S. Pat. No. 3,918,698 a jet of compressed air delivered from a nozzle folds a rolled plastic bag centrally between the laterally supported sub-sections of the rolling apparatus. The jet is in the form of an air knife which forces the bag into a pair of nip rolls which serve to deliver the rolled bag in a flattened-folded condition.

It has been found that the removal of the bag through the opening between the sub-sections must be carefully controlled to avoid wrinkling or creasing of the plastic sheet material. This is due to the fact that the rolled bag is processed into a flat geometry from a tubular geometry in conjunction with its removal from the rolling section. During the removal operation the bag is susceptible to wrinkling particularly at high folding speeds. High folding speeds are, however, necessary and desirable from a production standpoint.

In accordance with the present invention, it is proposed that high speed rolling and flatten-folding of a plastic article can be achieved by eliminating the space between the rolling cages and modifying the rolling cage into a single unitary section. The single unitary section is constructed so that the same rolling components used to roll the plastic article are also used to flatten-fold the rolled bag prior to any subsequent folding operation which might be required. In the present invention there is no need for the jet of air or pin and pneumatic cylinder combination required for the prior art apparatus described in the above patents for extracting the rolled bag from the rolling cage.

Accordingly, it is an object of the present invention to provide an improved flatten-folding machine for rolling plastic articles wherein the rolling components used to roll the plastic articles are also used to flatten the rolled article while it is being removed from the rolling cage.

Another object of the present invention is to provide an improved flatten-folding machine for rolling and flatten-folding plastic bags by forming each bag into a roll in a rolling section and thereafter utilizing components of the rolling section for discharging each rolled bag in a flattened state at relatively high speeds without introducing objectionable wrinkles.

These and other objects and advantages of the present invention will become apparent from the following detailed description of the invention when read in conjunction with the accompanying drawing in which.

In accordance with the present invention there is provided an improvement in an apparatus for flatten-folding flexible sheet material such as plastic bags, having rolling means for rolling the material into a roll, means for removing the rolled material from said rolling means, introduction means for introducing the material into said rolling means, and flatten-folding means for flattening the rolled material as desired during removal from said rolling means, the improvement wherein said rolling means comprises a rolling cage arranged in an arc circumscribing a minimum of 270° of a circle, said rolling cage being divided into a circumferentially disposed first roller section and a circumferentially disposed second roller section, said first roller section and said second roller section having a moving curved surface on its inward side through a substantial portion of said 270° for driving said material into a roll, and being divided by an intake passage for introducing said material into said rolling cage and an outlet passage for the passage of said material from said rolling cage, means for moving said first and second section for undirectional movement during rolling of said material in said rolling cage, means for reversing movement of said second section for discharge of rolled material from said roller section and means forming said outlet passage for removing and flattening rolled material from said roller cage.

The present invention also provides a method of flatten-folding flexible sheet material which comprises:

(a) providing a rolling zone having an inlet passage and a discharge and flattening passage, said rolling zone being divided into a first section and a second section, said first and second sections having a moving surface defining at least 270° of a circle having a partial enclosure of generally cylindrical configuration;

(b) permitting the moving surface of said first section and second section to move in a common direction;

(c) introducing said flexible sheet material into said rolling zone through said inlet passage into contact with the moving surface of said first section, and thence into contact with the moving surface of said second section to cause the flexible sheet material to be formed into a roll;

(d) reversing the direction of movement of the moving surface of said second section when said material is formed into a roll;

(e) directing said rolled material through said discharge and flattening passage to flatten and discharge said rolled material from said rolling zone.

Figure 1:
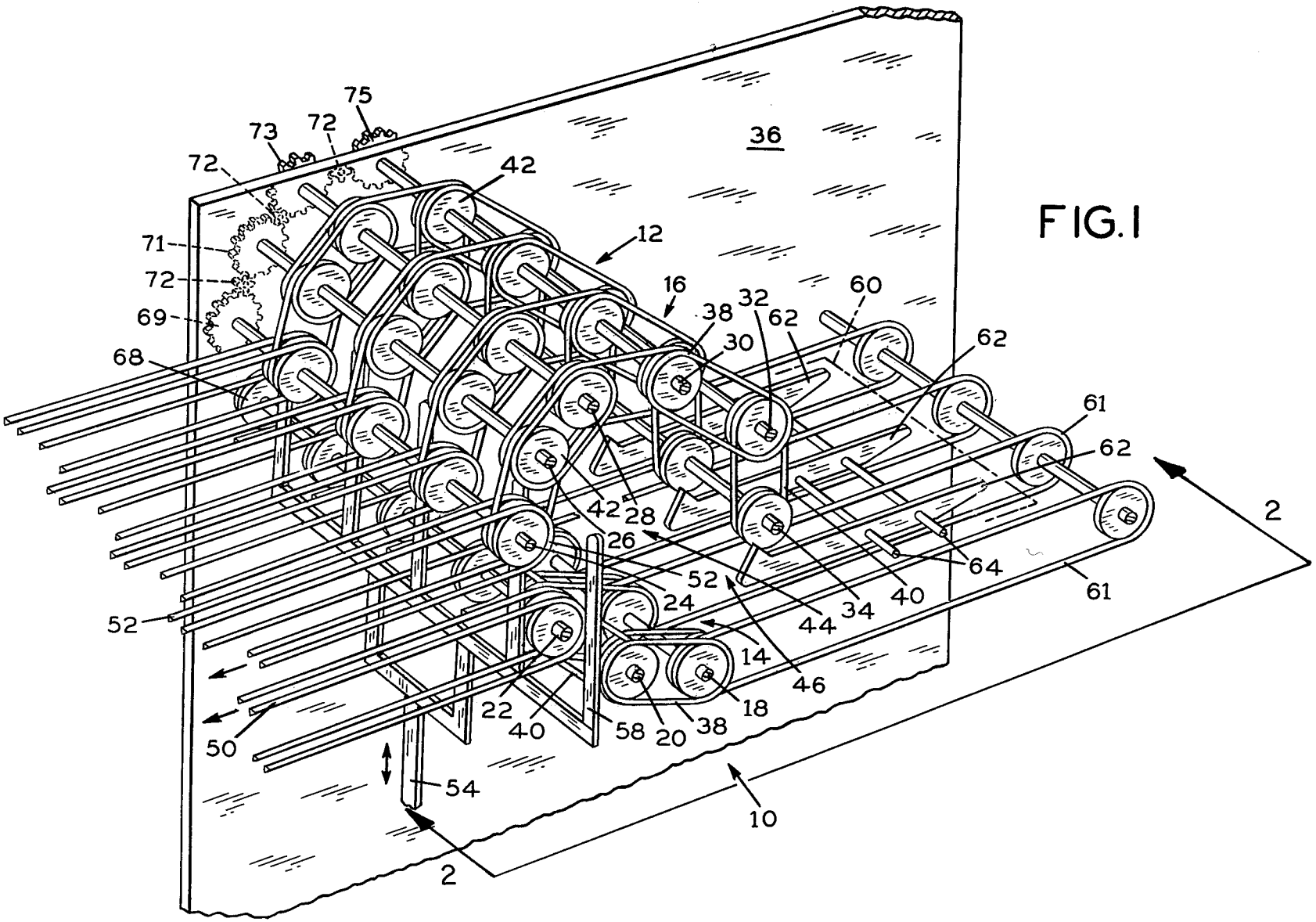
FIG. 1 is a perspective view of the rolling cage of the invention and further illustrating the feed and exit sections associated with the rolling cage.
Figure 2:
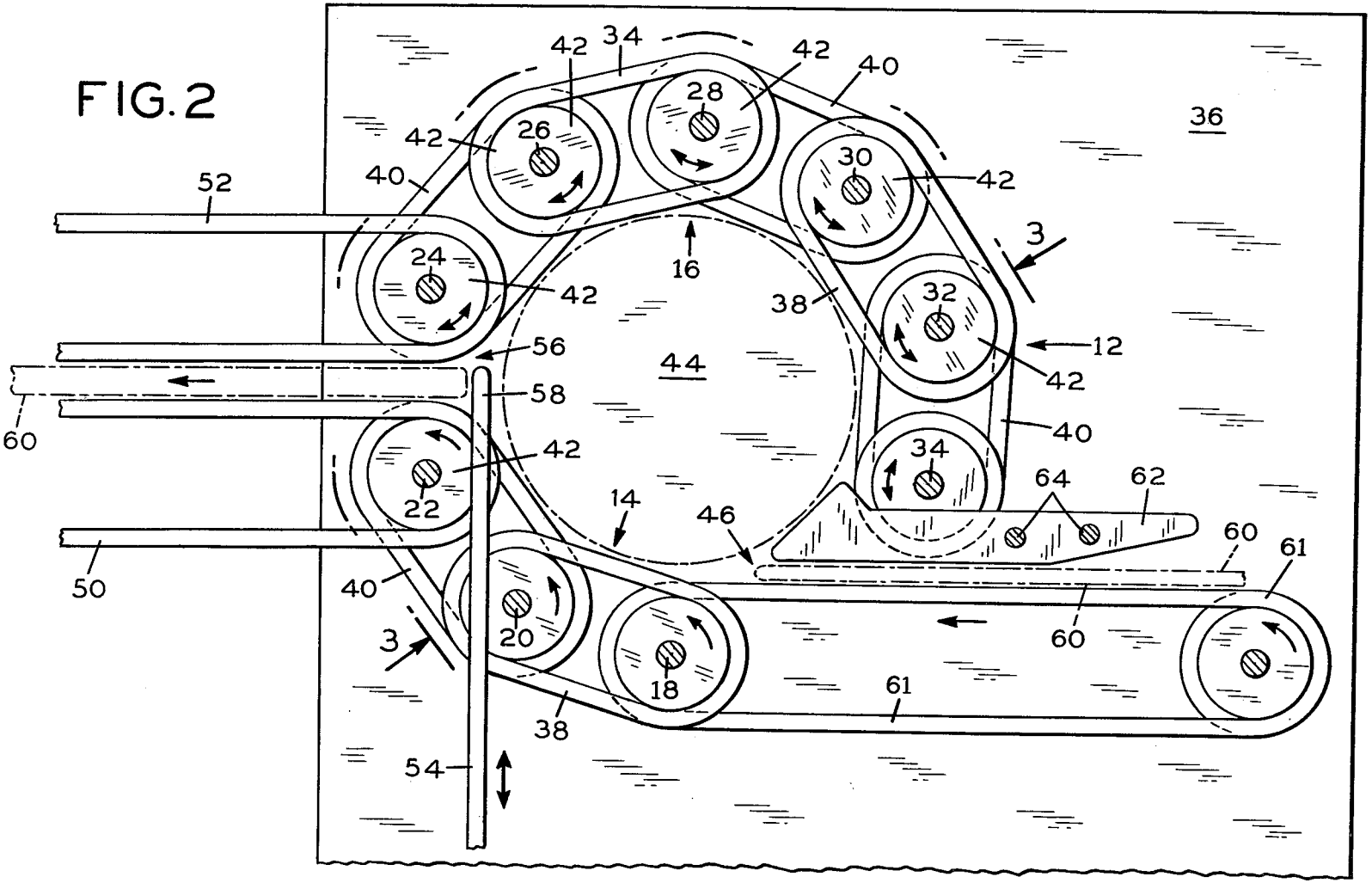
FIG. 2 is a vertical section taken generally along lines 2—2 of FIG. 1.
Figure 3:
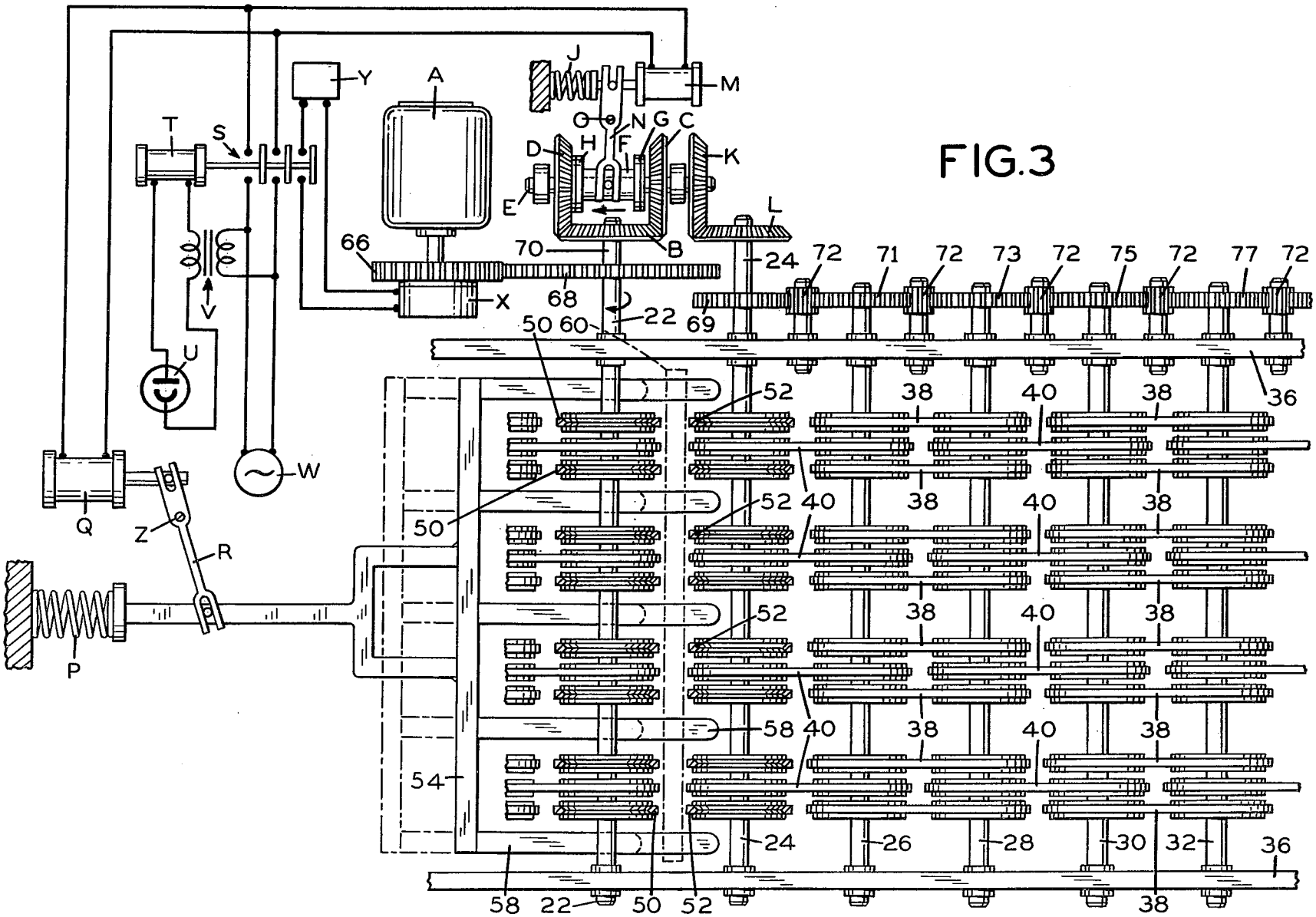
FIG. 3 is a development view taken generally along line 3—3 of FIG. 2 showing the roller section in flat or planar projection and further diagrammatically illustrating the sensing and operating means for the invention.

Referring now to FIGS. 1-3, inclusive illustrating the improved folding machine of the present invention in which plastic bags are individually wound into a roll of tubular geometry and flat folded. It should be understood that the bags are formed from any suitable polymeric material using any conventional bag making operation. The preferred bag is the "U" folded side seam welded bag having a seamless bottom. Although the folding machine of the present invention is intended primarily for folding bags, it is equally applicable for folding sheet goods of similar flexible material.

The folding apparatus, generally depicted by reference numeral 10, includes a rolling cage 12 which is divided into a circumferentially disposed first roller section 14 and a second roller section 16. The first roller section includes shafts 18, 20 and 22 and the second roller section includes shafts 24, 26, 28, 30, 32 and 34, all of which extend transversely across the rolling cage and all of which are rotatably supported between end plates 36. The rolling cage 12 is defined by a plurality of belts 38 and 40 interconnecting adjacent driven pulleys 42 rigidly mounted on each of the rotatable shafts. As best seen from FIG. 2 the belts 38, 40 are disposed at least 270° of a circle to form a partial enclosure 44 of generally cylindrical configuration with a periphery defining the inside moving surface of the belts for driving the bag around into a roll. The partial enclosure 44 leaves an opening 46, as best shown in FIG. 2, representing the intake passage to the rolling cage 12. Driving force is transmitted to the bag by friction between the belts and the bag itself. As best seen from FIG. 2 the belts 38, 40 are mounted on pulleys 42 all of which are of equal dimension and which are rigidly mounted to the rotatable shafts. Certain of the pulleys 42 are mounted on unidirectionally driven shafts 18, 20 and 22 which rotate in counterclockwise direction while the remaining pulleys are mounted on forward or reversibly driven shafts 24, 26, 28, 30, 32 and 34 and which can rotate in clockwise or counterclockwise direction. As best seen from FIG. 2 the pulleys 42 on shafts 22 and 24 are not interconnected by a belt but do support conveyor belts 50 and 52 mounted on pulleys supported by shafts 22 and 24 respectively and pulleys (not shown) supported distally from pulleys 42 which belts lead away from the rolling cage. Shafts 22 and 24 are spaced a greater distance from each other than are shafts 24, 26, 28, 30, 32 and 34 and shafts 22, 20 and 18 to provide an outlet passage 56 which lead the rolled bags between conveyor belts 50, 52 which flatten and discharge the rolled bag from rolling cage 12. A reciprocating guide or fence 54 is provided to selectively block or open the outlet passage 56 between the pulleys on shafts 22 and 24.

Thus as best seen from FIG. 1, fence assembly 54 is vertically disposed with respect to the rolling cage and has struts 58 which form a part of fence assembly 54. The struts together with the entire fence assembly is adapted to move upward and downward so that struts 58 in upward position blocks outlet passage 56 whereas in downward movement, outlet passage 56 provides free passage of a rolled bag onto conveyor belts 50, 52.

As mentioned previously, the partial enclosure 44 leaves an opening 46 representing the intake passage to the rolling cage 12. Referring to FIGS. 1 and 2 it will be seen that a bag 60 is disposed on guide belts 61 under guide rails 62. Guide rails 62 are supported by guide bars 64 which are mounted on end plates 36, and the forward edges of the guide rails terminate at intake passage 46. As the bag is delivered into the rolling cage, centrifugal force, bag material stiffness and the diameter of the bag as it is being rolled contribute to the normal force which holds the bag against the inner surface of belts 38, 40 and positively guide it to its rolled condition. Although not shown, it is within the scope of the present invention to use rotatable drive rollers disposed within the partial enclosure 44 in lieu of belts 38, 40 as disclosed and taught in my application U.S. Ser. No. 920,130 filed on June 28, 1978 now U.S. Pat. No. 4,183,515.

The drive system and control apparatus for the bag apparatus is of conventional parts and materials and one mode of operation is best illustrated in FIG. 3. Thus referring to FIG. 3, a unidirectional drive motor A has pinion gear 66 mounted thereon. Pinion gear 66 drives gear 68. Gear 68 is mounted on shaft 70 to drive shaft 22 connected at one end and bevel gear B connected at the opposite end. The motor rotates so as to drive in the direction of the arrow shown on the bevel gear B. Bevel gear B meshes with bevel gears C and D which are journaled on shaft E. Spool clutch element F is slideably mounted on shaft E but keyed thereto to prevent relative rotation between shaft E and element F. Clutch face H cooperates with the face on bevel gear D as a result of the spring loading of spring J to force clutch element F to the left. When face H engages bevel gear D, shaft E and the attached bevel gear K are forced to turn in the same direction as gear D. Since gear K meshes with bevel gear L, the gears 69, 71, 73, 75 and 77 through idler gears 72, all turn in the opposite direction of rotation to motor A. Since motor A is connected to shaft 22, through gears 66 to 68, shaft 22 rotates in a direction opposite to that of motor A; therefore, all belts 38 and 40 forming the internal cage surface will be moving in the same direction in this mode of operation.

When coil M is energized, spring J is compressed, face H is disengaged from the face of bevel gear D, clutch face G engages the face of bevel gear C resulting in a reverse of rotation of bevel gears K and L and, thereby, gears 69, 71, 73, 75 and 77. Although the belts driven by the shafts 24, 26, 28, 30 and 32 are reversed, the belts driven by shaft 22 is not reversed. The rolling cage thereby has an internal moving surface, part of which is moving in one direction and part in an opposite direction to cause the rolled bag 60 to be discharged through outlet passage 56 between belts 50 and 52.

The spring force of J or the electromagnetic force produced by coil M, when energized, causes yoke N to pivot in the selected direction about pin O to slide the spool clutch F to engage either bevel gear D or C.

Spring P causes fence assembly 54 to remain in interference and thereby block the passage 56 formed by belts 50 and 52 except when coil Q is energized. The electromagnetic force resulting from energizing coil Q causes yoke R to pivot about pin Z to compress spring P and lower gate fence assembly 54 and struts 58 from its interference position.

Coils M and Q are energized simultaneously when switch S is closed by coil T. Coil T is energized when photocell U senses the end of the bag to be rolled entering the rolling cage; therefore, the photo cell is physically located to sense the end of the bag as it passes 46, the entrance passage to the rolling cage. The photocell U also causes the clutch-brake unit X to be energized when it senses the end of the bag to brake the motor and attached gearing to a complete stop. Energizing the brake also starts timer Y which subsequently releases the brake and connects the motor to the drive system through the clutch of the clutch-brake unit X. Coils M and Q remain energized a sufficient amount of additional time to allow the rolled bag to be removed from the cage before the photocell U is reset. Transformer V is connected to a power source W to maintain a potential on the photocell control circuit.

In operation, the photocell U senses the end of the bag and simultaneously energizes coils Q and M to retract the struts 58 of the fence assembly 54 out of interference and reverse the direction of rotation of a portion of the pulley shafts, thereby reversing the direction of motion of a portion of the internal surface of the rolling cage to thereby flatten and remove the rolled bag from the cage.

In a typical mode of operation for rolling and flattening sheet material such as a bag, and utilizing the apparatus shown in FIGS. 1–3, bag 60 is introduced into the rolling cage 12 by means of guide belts 61. At this point, belts 38 and 40 are all moving in a common direction by virtue of the drive system and control apparatus described previously and the fence assembly is in its up most position with struts 58 blocking discharge passage 56.

As the bag is completely rolled in the rolling cage, the shafts and pulleys in the second section of the rolling cage are reversed in direction, and the struts are dropped out of interference with discharge or outlet passage 56. By the action of the moving surfaces of the first and second sections of the rolling cage, the rolled bag is urged between belts 50, 52 where it is flattened between the confronting surfaces of the belts. For many uses the flattened bag is considered appropriately folded at this point. However if additional folding is desired the bag can be directed to additional folding devices.

It will be obvious that while the present invention has been set forth in some detail and described with particularity, it is susceptible to changes, modifications and alterations without departing from the scope and spirit of the invention as defined in the appended claims.

What is claimed is:

1. In a machine for rolling and flatten-folding flexible sheet material, having rolling means for rolling the material into a roll, discharge means for removing the rolled material from said rolling means, inlet means for introducing the material into said rolling means, and folding means for folding the rolled material as desired after removal from said rolling means, the improvement which comprises: Rolling means comprising a rolling cage having an inner surface arranged in an arc circumscribing a minimum of 270° of a circle for defining said rolling cage, said rolling cage being divided into a circumferentially disposed first roller section and a circumferentially disposed second roller section, said first roller section having a first movable curved surface on its inward side and said second roller section having a second movable curved surface on its inward side, said first and second movable curved surfaces defining a portion of said 270° arc and being adapted for driving said material into a roll, and said first and second roller sections being divided by an intake passage for introducing said material into said rolling cage and an outlet passage for discharging said material from said rolling cage; means for moving said first and second movable curved surfaces in undirectional movement during rolling of said material in said rolling cage; and means for reversing movement of said second movable curved surface for discharge of rolled material from said roller section.

2. The machine defined in claim 1 further including means communicating with said outlet passage for removing and flattening rolled material from said roller cage.

3. The machine as defined in claim 1 further including blocking means for blocking said outlet passage when said first and second movable curved surfaces are moving in a common direction.

4. The machine as defined in claim 3 wherein said blocking means includes a movable fence assembly having a system of struts adapted to block said outlet passage when said fence is moved into extended position.

5. The machine as defined in claim 1 wherein the movable curved surfaces of said first and second roller sections are defined by a system of movable belts.

6. The machine as defined in claim 1 wherein each of said first and second roller sections is formed from a plurality of belts engaging interconnecting adjacent driven pulleys extending transversely across the rolling cage.

7. The machine as defined in claim 1 wherein the moving surface of said first and second roller sections is defined by a system of rotating means.

8. The machine as defined in claim 2 wherein said means communicating with said outlet passage for removing and flattening rolled material from said roller cage include a plurality of conveyor belts arranged in superimposed relation and adapted for movement away from said roller cage, and wherein said rolled material is removed from said roller cage by directing the rolled material towards confronting surfaces of said conveyor belts.

9. A method of folding flexible sheet material which comprises:

(a) providing a rolling zone having an inlet passage and a discharge and flattening passage, said rolling zone being divided into a first section and a second section, said first and second sections having a moving surface defining at least 270° of a circle to form a partial enclosure of generally cylindrical configuration;

(b) permitting the moving surface of said first section and second section to move in a common direction;

(c) introducing said flexible sheet material into said rolling zone through said inlet passage into contact with the moving surface of said first section, and thence into contact with the moving surface of said second section to cause the flexible sheet material to be formed into a roll;

(d) reversing the direction of movement of the moving surface of said second section when said material is formed into a roll; and (e) directing said rolled material through said discharge and flattening passage to discharge said rolled material from said rolling zone and flatten said rolled material.

10. The method as defined in claim 9 wherein said discharge and flattening passage is blocked during step (c) and unblocked during steps (d) and (e).

* * * * *